US006223511B1

(12) United States Patent
Brazeau

(10) Patent No.: US 6,223,511 B1
(45) Date of Patent: May 1, 2001

(54) APPARATUS FOR HELICALLY ASSEMBLING AT LEAST TWO FILAMENTS

(75) Inventor: Michel Brazeau, St-Hippolyte (CA)

(73) Assignee: Lefebvre Frères Limitée, Montreal (CA)

( * ) Notice: Subject to any disclaimer, the term of this patent is extended or adjusted under 35 U.S.C. 154(b) by 0 days.

(21) Appl. No.: 09/515,918

(22) Filed: Mar. 1, 2000

Related U.S. Application Data

(63) Continuation of application No. PCT/CA99/00339, filed on Apr. 19, 1999.

(30) Foreign Application Priority Data

Apr. 17, 1998 (CA) ..... 2235170

(51) Int. Cl.[7] ..... D07B 3/04
(52) U.S. Cl. ..... 57/16; 57/13; 57/17
(58) Field of Search ..... 57/13, 14, 16, 57/17, 18, 62, 67, 71, 68, 58.38, 58.3, 59, 314, 15

(56) References Cited

U.S. PATENT DOCUMENTS

| | | | | |
|---|---|---|---|---|
| 1,843,075 | * | 1/1932 | Angell | 57/16 |
| 2,445,365 | | 7/1948 | Reardon . | |
| 2,566,973 | | 9/1951 | Yake . | |
| 2,567,329 | * | 9/1951 | Frazier | 57/16 |
| 2,941,348 | | 6/1960 | Biche et al. . | |
| 2,967,390 | | 1/1961 | McCormick . | |
| 3,059,404 | | 10/1962 | Benfer et al. . | |
| 3,142,952 | * | 8/1964 | Kraft et al. | 57/16 |
| 3,183,583 | | 5/1965 | Ostermann . | |
| 3,286,451 | * | 11/1966 | Woolman | 57/16 |
| 3,392,933 | | 7/1968 | Singh . | |
| 3,720,054 | | 3/1973 | Haehnel et al. . | |
| 3,727,390 | | 4/1973 | Schwarz . | |
| 3,955,348 | * | 5/1976 | Orlandi | 57/16 |
| 4,663,928 | | 5/1987 | Delobel et al. . | |
| 4,709,542 | | 12/1987 | Krafft . | |

FOREIGN PATENT DOCUMENTS

| | | |
|---|---|---|
| 625 749 | 12/1946 | (DE) . |
| 2 453 933 | 11/1980 | (FR) . |

OTHER PUBLICATIONS

"Machine for twisting a 2 x 1–cord" Research Disclosure, No. 273, Jan. 1987, New York, N.Y.

* cited by examiner

*Primary Examiner*—Danny Worrell
(74) *Attorney, Agent, or Firm*—Swabey Ogilvy Renault; Michel Sofia

(57) ABSTRACT

An apparatus (310) for manufacturing stranded cables comprises a supply spool assembly (320, 322) having filaments wound thereon, and a flyer (316) mounted for rotation about a central axis for imparting a rotational movement to the filaments, while guiding them axially through the apparatus (310). The filaments are wound together as they pass a gathering point centrally disposed to the central axis and downstream of the flyer (316). A filament advancing assembly (16) is provided downstream of the gathering point to impart an advancing speed to the filaments. A control system allows for the control of the number of revolutions of the flyer (316) per unit length of filaments advancing through the gathering point to ensure that a constant helical pitch is obtained. The tension in the filaments is controlled by creating an adjustable opposition to the pulling action of the filament advancing assembly (16) on the filaments thereby ensuring the production of a high quality stranded cable.

30 Claims, 9 Drawing Sheets

APPARATUS FOR HELICALLY ASSEMBLING AT LEAST TWO FILAMENTS

RELATED APPLICATIONS

This is a continuation of International PCT Application No. PCT/CA99/00339 filed on Apr. 19, 1999, which claims the benefit of Canadian Application No. 2,235,170.

BACKGROUND OF THE INVENTION

1. Field of the invention

The present invention relates to an apparatus of the type used for helically assembling filaments or elongated flexible elements together to form a cable or the like.

2. Description of the Prior Art

U.S. Pat. No. 4,709,542 issued to Krafft on Dec. 1, 1987, discloses a stranding apparatus adapted to form stranded cables of infinite lengths.

More specifically, Krafft discloses a cable assembly apparatus having a rotating shaft which is provided with two integral supply reels which are respectively adapted to receive thereon a group of wire elements. The flyer assembly rotates around the supply reels for unwinding the groups of wire elements therefrom. The flyer assembly is rotated in the same direction as the two integral supply reels but at a speed which causes the wire elements to be unwound from the supply reels. A drive motor is directly connected to the rotating shaft for driving the integral supply reels. The flyer assembly is connected to the same drive motor but through a variable diameter pulley assembly so that the rotational speed of the flyer assembly is adjustable with respect to that of the integral supply reels. The apparatus further comprises a gathering assembly which is mounted for rotation with the flyer assembly for gathering and twisting the individual wire elements together or over a core element to form a cable. A take-up reel is disposed downstream from the gathering assembly to receive thereon the finished cable coming out from the center of the rotating shaft. A motor is coupled to the take-up reel to enable the same to be operated to draw the cable from the gathering assembly. The motor of the take-up reel may be adjusted to maintain a desired amount of tension in the cable to enhance the quality of the finished cable. However, it is the rates of rotation of the integral supply reels and of the flyer assembly which control the rate of production of the cable and thus the tension which is applied to the cable does not change the rate at which the cable is produced. Indeed, an increase of the rotational speed of the take-up reel does not change the rotational speed of the integral supply reels as the same are not allowed to freely rotate on the rotating shaft thereof. Accordingly, in order to obtain a desired length of twist per unit length of cable, the rotational speed of the flyer assembly must be adjusted relative to the rotational speed of the integral supply reels.

It is believed that the apparatus of the above described patent never gained commercial acceptance as the helical pitch of the final product and the amount of tension in each supply wire were overly difficult to control.

FIG. 8 illustrates a conventional apparatus 410 used in steel industries to helically assemble a plurality of individual strands together about a central core to form a steel cable.

The apparatus 410 generally comprises a rotatable tube 412 mounted to a frame structure 414 for rotation about a central axis, and a plurality of supply spools 416, 418, 420 and 422 mounted for rotation about respective transversal axes. The supply spools 416, 418, 420 and 422 have respective strands 424, 426, 428 and 430 wound thereon. A capstan 432 is disposed downstream of the tube 412 for pulling the strands 424, 426, 428 and 430 out of a matrice 434 provided at the downstream end of the tube 412 for helically assembling the individual strands 424, 426 and 428 together about the central strand 430. The spools 418, 420 and 422, which are disposed within the tube 412, are supported by respective non-rotatable cradles 436, whereas the spool 416, which is disposed upstream of the tube 412, may be supported by any suitable support structure (not shown). The tube 412 defines at an upstream end thereof a first central passage 438 for allowing the strand 424 of the supply spool 416 to access the interior of the tube 412. Furthermore, the tube 412 defines at a downstream end thereof a second central passage 440 for allowing the strand 430 of the spool 422 to pass through the apparatus 410 along the central axis without being twisted to form the central core of the cable. Pulleys 442 connected to the tube 412 are provided between the spools 416 418, 420 and 422 along the central axis for engaging the strands 424, 426 and 428 before the same be directed to other pulleys 444 mounted to the external surface of the tube 412.

In operation, the capstan 432 is activated to advance strands 424, 426, 428 and 430 through the apparatus 410, while the tube 412 is driven in rotation to cause the strands 424, 426 and 428 to rotate about the central strand 430. It is noted that the strands 424, 426 and 428 are twisted onto themselves as they engage respective pulleys 442 and are untwisted when they leave the tube 412, i.e. when they pass over the last pulleys 444 disposed at the downstream end of the tube 412, thereby ensuring that each individual strand be untwisted in the assembled product. Finally, the strands 424, 426 and 428 are helically assembled together on the central strand 430 as they return to the central axis within the matrice 434. As seen in FIG. 8, the assembled product may be wound on a take-up spool 446 disposed downstream of the capstan 432.

Basically, the above stranding apparatus 410 is intended for producing steel cables formed of a plurality of strands helically assembled on a central core and is thus not well adapted for manufacturing twisted pair cables, such as those used for transmitting messages.

FIG. 9 illustrates a conventional apparatus 510 for manufacturing twisted pair cables, i.e. cables composed of two strands helically assembled together about a central axis. Such an apparatus generally comprises a main flyer 512 adapted to impart a double twist to a pair of strands 514 and 516 emanating from a matrice 518. The two strands 514 and 516 are wound on respective supply spools 520, 522 and directed onto two distinct rotating flyers 524 and 526 which are driven in rotation so as to suppress the twist which is imparted to the strands 514 and 516 in order to ensure that each strand 514, 516 be not twisted onto itself in the assembled product. The assembled product may be received on a take-up spool 528 disposed inside of an envelope defined by the rotational movement of the main flyer 512.

Although the above apparatus 510 performs satisfactorily in many applications, it has been found that there is a need for a simpler and less expensive apparatus which does not necessitate the utilisation of three flyers.

SUMMARY OF THE INVENTION

It is therefore an aim of the present invention to provide an apparatus for helically assembling filaments about a common axis or, alternatively, over a core element to produce a cable.

It is also an aim of the present invention to provide an apparatus which is adapted to hellically assemble a pair of filaments about a central axis.

It is a still further aim of the present invention to provide such an apparatus which is adapted to produce cables or the like having substantially uniform helical pitches throughout the length thereof.

It is a still further aim of the present invention to provide such an apparatus which is capable of adjusting an controlling the amount of tension in each individual filament passing through the apparatus.

It is a still further aim of the present invention to provide such an apparatus which is provided with removable supply spools.

Therefore, in accordance with the present invention, there is provided a supply spool and flyer assembly for an apparatus adapted to hellically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means, with second guide means configured to cause said second filament to rotate with said axle means about said central axis as said second filament is moved through said second guide means.

Also in accordance with the present invention, there is provided a supply spool and flyer assembly for an apparatus adapted to hellically assemble a pair of elongated flexible elements about a central axis as said elongated flexible elements are passed through a gathering point, said supply spool and flyer assembly comprising first supply spooling means having a first elongated flexible element wound thereon, flyer means disposed downstream of said first supply spooling means and upstream of the gathering point, said flyer means being mounted on axle means for rotation therewith about said central axis and defining a first guide path for said first elongated flexible element, whereby rotation of said flyer means will cause said first elongated flexible element to rotate about said central axis as said first elongated flexible element is moved through said first guide path, and second supply spooling means disposed within an envelope defined by a rotational movement of said flyer means about said central axis, said second supply spooling means having a second elongated flexible element wound thereon, said second elongated flexible element being moved through a second guide path extending through said axle means and to the gathering point so as to deviate off-axis said second elongated flexible element at a location comprised between said envelope and the gathering point, whereby rotation of said axle means will cause said second elongated flexible element to rotate about said central axis such that when said first and second elongated flexible elements return to the central axis at the gathering point, said first and second elongated flexible elements will be hellically assembled together.

Also in accordance with the present invention, there is provided an apparatus for hellically assembling elongated flexible elements about a common axis to form a product, comprising at least two supply spooling means having respective elongated flexible elements wound thereon, flyer means adapted to cause said elongated flexible elements to rotate about said common axis as said elongated flexible elements pass thereon, and a tension equaliser disposed between said flyer means and an element gathering point disposed outside of said flyer means, said tension equaliser being effective for equalising the tension in said elongated flexible elements before the same be hellically assembled together at said element gathering point.

Also in accordance with the present invention, there is provided a helical pith control system for a stranding apparatus adapted to produce a stranded cable, comprising flyer means adapted to cause filaments passing thereon to rotate about a central axis, capstan means adapted to draw the filaments from said flyer means, said capstan means including a number of interchangeable capstan wheels of different diameters adapted to engage said filaments so as to impart an advancing speed to said filaments, said advancing speed being a direct function of the diameter of said interchangeable capstan wheels and of a rotation speed thereof, motor means for driving said flyer means and said capstan means at a predetermined speed ratio, whereby said interchangeable capstan wheels are selected according to a desired helical pith of a stranded cable to be manufactured.

Still in accordance with the present invention, there is provided a system for controlling the amount of tension in a filament being drawn off from a supply spooling means, comprising braking means for exerting an adjustable opposition to a rotation of said supply spooling means, clutch means adapted to generate a coupling torque for coupling said supply spooling means to driving means, and control means for adjusting the opposition of said braking means to the rotation of said supply spooling means so as to maintain a desired amount of tension in said filament, whereby when said coupling torque of said clutch means is less than said opposition exerted on said supply spooling means by said braking means, said clutch means slips thereby preventing said supply spooling means from being driven by said driving means, and when said opposition of said braking means becomes less than said coupling torque of said clutch means, said supply spooling means is driven by said driving means via said clutch means.

Still in accordance with the present invention, there is provided an apparatus for helically assembling individual elongated flexible elements about a common axis to form a product, comprising at least two independent supply spooling means mounted for rotation about an axis, each said supply spooling means having a single elongated flexible element wound thereon, flyer means mounted for rotation about said axis and around said supply spooling means, means for rotating said flyer means about said axis, said elongated flexible elements being directed from said supply spooling means to said flyer means and then to a gathering point wherein said elongated flexible elements are helically assembled about said axis according to a rotational movement of said flyer means, advancing means for advancing said elongated flexible elements through said apparatus, and a tension adjusting means adapted to independently act on said supply spooling means to maintain a desired amount of tension in each said elongated flexible element.

Also in accordance with the present invention, there is provided an apparatus for assembling at least one individual elongated flexible element on an advancing core to form a product, comprising at least one independent supply spooling means mounted for rotation about an axis, said supply spooling means having a single elongated flexible element wound thereon, flyer means mounted for rotation about said axis and around said supply spooling means, means for rotating said flyer means about said axis, said elongated flexible element being directed from said supply spooling means to said flyer means and then to a gathering point wherein said elongated flexible element is helically assembled around said core passing axially through said gathering point, advancing means for advancing said elongated flexible element and said core through said apparatus, and a tension adjusting means adapted to independently act on said supply spooling means to maintain a desired amount of tension in said elongated flexible element thereof.

Further in accordance with the present invention, there is provided an apparatus for helically assembling filament means about a common axis to form a product, comprising at least two supply spooling means mounted for rotation about an axis, each said supply spooling means having filament means wound thereon, flyer means mounted for rotation about said axis and outwardly of said supply spooling means, means for rotating said flyer means about said axis, said filament means being directed from said supply spooling means to said flyer means and then to a gathering point wherein said filament means are helically assembled about said axis according to the rotational movement of said flyer means, advancing means for pulling said filament means off said supply spooling means and for imparting an advancing speed to said filaments means through said apparatus, and means for controlling and adjusting the speed ratio between the advancing speed of said filament means and a rotational speed of said flyer means to achieve a substantially uniform number of rotations of said flyer means per unit of length of said product.

Still further in accordance with the present invention, there is provided an apparatus for helically assembling at least one filament means on an advancing core to form a product, comprising at least one supply spooling means mounted for rotation about an axis, said supply spooling means having filament means wound thereon, flyer means mounted for rotation about said axis and outwardly of said supply spooling means, means for rotating said flyer means about said axis, said filament means being directed from said supply spooling means to said flyer means and then to a gathering point wherein said filament means is helically assembled around said advancing core passing axially through said gathering point, advancing means for pulling said filament means off said supply spooling means and for imparting an advancing speed to said filament means and to said advancing core through said apparatus, and means for controlling and adjusting the speed ratio between the advancing speed of said filament means and a rotational speed of said flyer means to achieve a substantially uniform number of rotations of said flyer means per unit of length of said product.

Still further in accordance with the present invention, there is provided an apparatus for assembling filament means about a common axis, comprising a plurality of supply spool and flyer assemblies disposed in series, each said supply spool and flyer assembly including at least one supply spooling means mounted for rotation about an axis and a flyer means also mounted for rotation about said axis and outwardly of said supply spooling means, said at least one spooling means having filament means wound thereon, said filament means being directed from said supply spooling means to said flyer means, said flyer means of said plurality of supply spool and flyer assemblies being rotated substantially at a same speed and in a same direction, a gathering point for receiving said filament means from a downstream end of said plurality of supply spool and flyer assemblies, said filament means being assembled about said axis at said gathering point according to a rotational movement of said flyer means, advancing means for displacing forward said filament means through said plurality of supply spool and flyer assemblies and through said gathering point.

Still further in accordance with the present invention, there is provided an apparatus for assembling filaments means on an advancing core comprising a plurality of supply spool and flyer assemblies disposed in series, each said supply spool and flyer assembly including at least one supply spooling means mounted for rotation about an axis and a flyer means also mounted for rotation about said axis and outwardly of said supply spooling means, said spooling means having filament means wound thereon, said filament means being directed from said supply spooling means to said flyer means, said flyer means of said plurality of supply spool and flyer assemblies being rotated substantially at a same speed and in a same direction, a gathering point for receiving said filament means and said advancing core from a downstream end of said plurality of supply spool and flyer assemblies, said filament means being assembled around said advancing core at said gathering point according to a rotational movement of said flyer means, advancing means for displacing forward said filament means and said advancing core through said plurality of supply spool and flyer assemblies and through said gathering point.

BRIEF DESCRIPTION OF THE DRAWINGS

Having thus generally described the nature of the present invention, reference will now be made to the accompanying drawings, showing by way of illustration a preferred embodiment thereof and in which.

DESCRIPTION OF THE PREFERRED EMBODIMENTS

Figure 1:
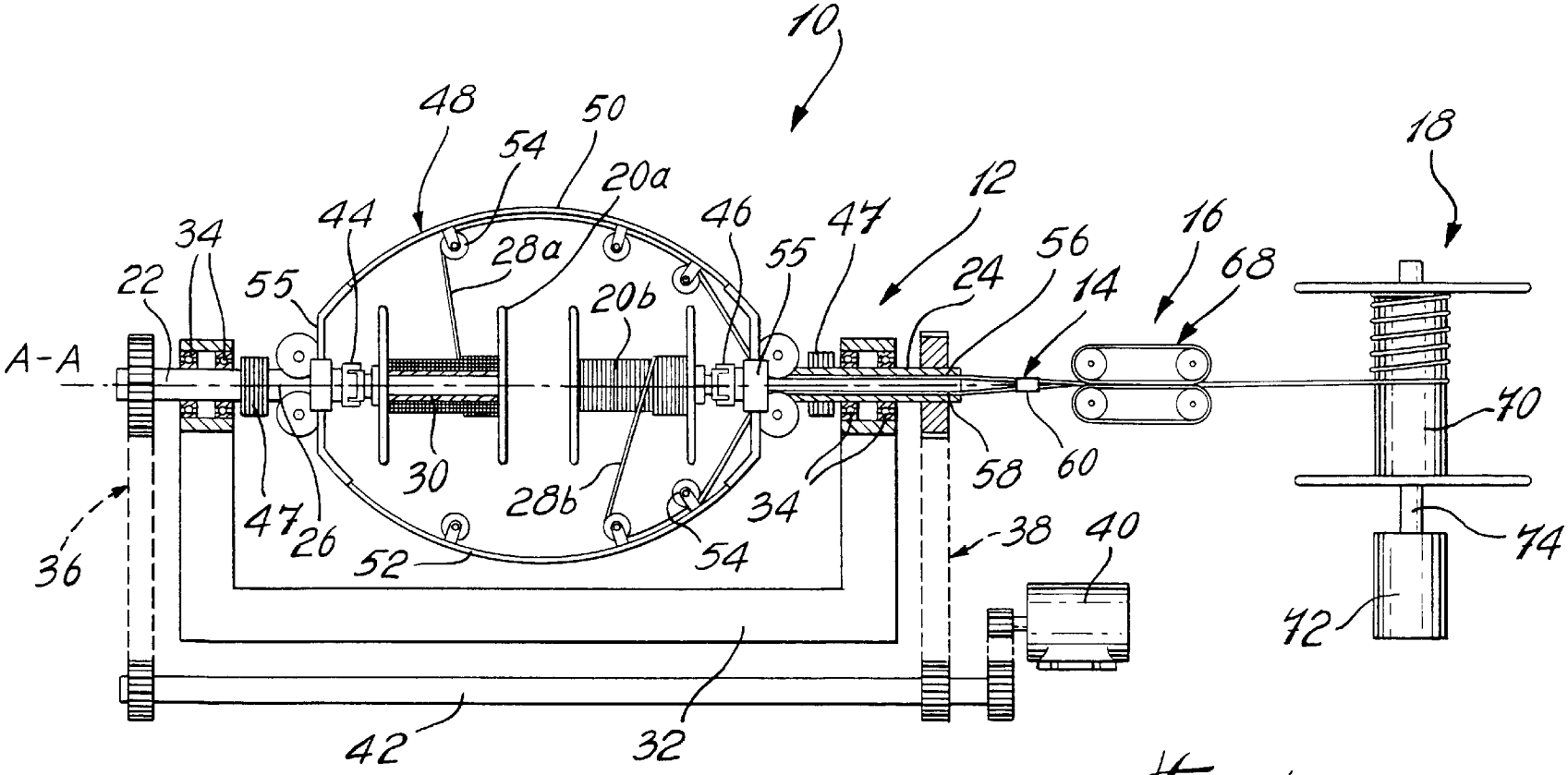
FIG. 1 is a schematic side elevational view of a cable assembly apparatus according to the present invention.

Now referring to the drawings, and in particular to FIG. 1, an apparatus for helically assembling elongated flexible elements, such as individuals wires or the like, embodying the elements of the present invention and generally designated by numeral 10 will be described.

The apparatus 10 is suitable for a variety of industrial applications such as the manufacture of products such as electrical cables, local area network (LAN) cables and the like. As shown in FIG. 1, the apparatus 10 comprises a supply spool and flyer assembly generally indicated at 12, a gathering assembly 14, a filament advancing assembly 16 for pulling a product out of the gathering assembly 14 and, a take-up spool assembly 18 for receiving the product.

More particularly, the supply spool and flyer assembly 12 includes two supply spools 20*a* and 20*b* mounted on respective shafts 22 and 24 for rotation about a common axis 26. The supply spool 20*a* has an elongated flexible element 28*a* wound thereon. Similarly, supply spool 20*b* has an elongated flexible element 28*b* wound thereon. The elements 28*a* and 28*b* may each be formed of a single strand or, alternatively, of a pre-assembled cable composed, for instance, of a pair of hellically assembled strand or filaments. Cylindrical tubular members 30, acting as spool shafts, are mounted on bearings at free ends of the shafts 22 and 24 for receiving thereon respective supply spools 20*a* and 20*b*. A locking mechanism (not shown) is provided to ensure that the spools 20*a* and 20*b* remain in position on their respective cylindrical tubular members 30 when the shafts 22 and 24 are rotated. Each shaft 22 and 24 is mounted at an opposed end portion thereof to a frame 32 by means of a pair of bearings 34 for rotation about the common axis 26. The shafts 22 and 24 are respectively rotatably driven by conventional belt and pulley assemblies 36 and 38 which are both connected to a single motor 40 through a connecting shaft 42. It is pointed out that the belt and pulley assemblies 36 and 38 are configured so as to ensure that the rotating shafts 22 and 24 rotate in unison, although they are not directly connected to each other.

An electro-mechanical brake, such as hysteresis brake 44, is mounted on rotating shaft 22 adjacent the supply spool 20*a* and is operational to apply a magnetising torque on the cylindrical tubular member 30 of the supply spool 20*a*. Similarly, a hysteresis brake 46 is mounted on rotating shaft 24 adjacent supply spool 20*b* and is operational to apply a magnetising torque on the cylindrical tubular member 30 of the supply spool 20*b*. Accordingly, the hysteresis brakes 44 and 46 may be activated to respectively couple the supply spools 20*a* and 20*b* to the rotating shafts 22 and 24 so that the supply spools 20*a* and 20*b* may rotate jointly with their respective rotating shafts 22 and 24 when no exterior force, such as a pulling force exerted on the elements 28*a* and 28*b*, acts thereon. However, it is pointed out that the rotational speed of the supply spools 20*a* and 20*b* may be different, i.e. greater or less than the rotational speed of the rotating shafts 22 and 24, as bearings are disposed within each cylindrical tubular member 30. As will be explained in more details hereinafter, the hysteresis brakes 44 and 46 permit to properly and efficiently control the amount of tension in each elements 28*a* and 28*b* to thus enhance the overall quality of the cable produced by the apparatus 10. A conductive element, such as a brush 47, is provided on each rotating shaft 22 and 24 for conducting current to the hysteresis brakes 44 and 46 and/or to any other electrical component, such as sensors, which are located in the surroundings of the rotating shafts 22 and 24.

The supply spools 20*a* and 20*b* are removably mounted to their respective rotating shafts 22 and 24 so that when desired or required they may be easily removed from the apparatus 10 and replaced by other supply spools having similar or different sizes and configurations. As shown in FIG. 1, the rotating shafts 22 and 24 are mounted to the frame 32 so as to define a free space between the end portions thereof which respectively supports the supply spools 20*a* and 20*b*, thereby enabling the manipulation and removal of the supply spools 20*a* and 20*b*.

The elements 28*a* and 28*b* wound onto the supply spools 20*a* and 20*b* are directly guided to a flyer 48 which is mounted for rotation about the common axis 26. The flyer 48 includes two diametrically opposite arcuate members 50 and 52 which are provided on inner facing surfaces thereof with a plurality of guides 54, such as pulleys or eyelets, for receiving the elements 28*a* and 28*b*. As seen in FIG. 1, the element 28*a* is directed to the arcuate member 50, whereas element 28*b* is directed to the arcuate member 52. Each arcuate member 50 and 52 is fixedly mounted at opposed ends thereof to the rotating shafts 22 and 24 for rotation therewith. As schematically illustrated in FIG. 1, end bells 55 may be provided to secure the arcuate members 50 and 52 to the rotating shafts 22 and 24. The arcuate members 50 and 52 extend in substantially opposite radial positions with respect to the common axis 26 and are operational to rotate around the supply spools 20*a* and 20*b*. As shown in FIG. 1, the supply spools 20*a* and 20*b* are disposed and configured to be within the arc or envelope defined by the rotational movement of the flyer 48. By mounting the flyer 48 and the supply spools 20*a* and 20*b* for rotation about the same axis and by directly guiding the elements 28*a* and 28*b* onto the flyer 48, the elements are not twisted at their point of entry on the flyer 14. Therefore, it becomes possible to twist the elements 28*a* and 28*b* only outside of the flyer 48, i.e. downstream of the supply spool and flyer assembly 12 at a gathering point thereof. In most of the conventional cable assembly apparatuses, the supply elements are not directly guided onto the rotating flyer and thus they are submitted to a twisting torque at their point of entry in the rotating flyer, which is detrimental to the overall quality of the assembled product.

Two parallel off-centre axial passages 56 and 58 are defined in the rotating shaft 24 for respectively allowing elements 28*a* and 28*b* to exit the supply spool and flyer assembly 12. However, it is understood that any other suitable passage or guide may be used to permit the elements 28*a* and 28*b* to be pulled out of the supply spool and flyer assembly 12.

Figure 2:
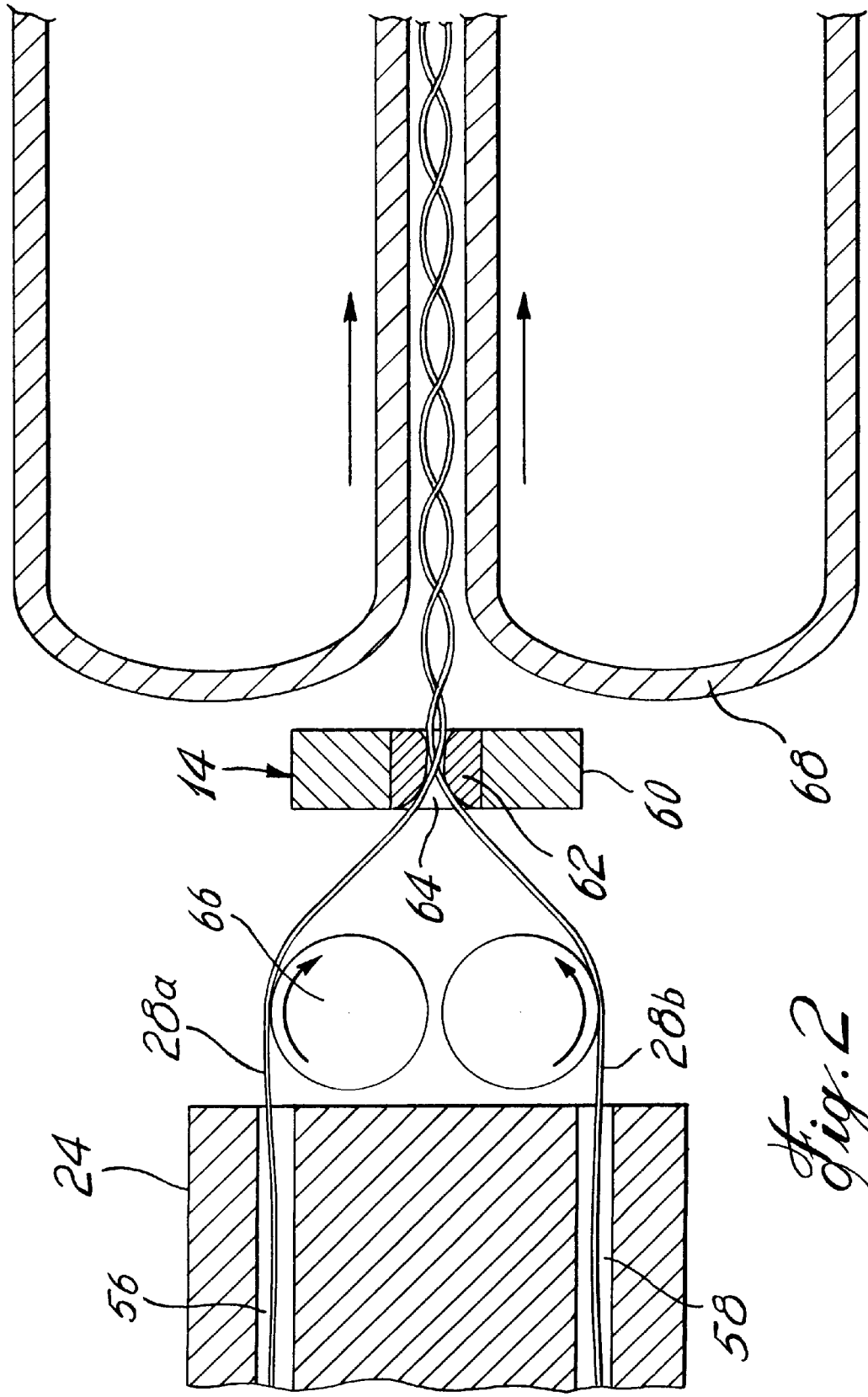
FIG. 2 is a schematic enlarged cross-sectional view of a gathering assembly of the cable assembly apparatus of FIG. 1.

The gathering assembly 14 is located downstream of the supply spool and flyer assembly 12 and is positioned so as to assemble the elements 28*a* and 28*b* together about the common axis 26. As shown in FIG. 2, the gathering assembly 14 is independent of the supply spool and flyer assembly 12 and includes a closing die 60 having a diamantane insert 62 defining an axial passage 64 in which the elements 28*a* and 28*b* are helically assembled as they pass therethrough. It is pointed out that for applications which do not necessitate a high rotational speed of the flyer 48 and a high advancement speed of the elements 28*a* and 28*b* through the closing die 60, the gathering assembly 14 may be non-rotatably secured in position, as the friction exerted by the elements 28*a* and 28*b* on the inner surface of diamantane insert 62 is not sufficient to cause damage thereto. However, it is understood that when the apparatus 10 operates at relatively high speeds, the closing die 60 may be rotated at the same speed as the flyer 48 to thus eliminate the relative rotational movement existing between the elements 28*a* and 28*b* and the closing die 60, whereby the friction between the diamantane insert 62 and the elements 28*a* and 28*b* will be only generated by the axial displacement of the elements 28*a* and 28*b* through the closing die 60. Some pulleys 66 may be provided at the exit end of the shaft 24 to convey the elements 28*a* and 28*b* into the gathering assembly 14 and to collect information, as will be described in more details hereinafter.

It is noted that the gathering assembly 14 is optional. In the event that a gathering assembly 14 is not provided, the elements 28*a* and 28*b* will be assembled together at a gathering point disposed between the supply spool and flyer assembly 12 and the filament advancing assembly 16.

The filament advancing assembly 16 is disposed downstream of the gathering assembly 14 and is operational for advancing the elements 28*a* and 28*b* through the supply spool and flyer assembly 12 and through the gathering assembly 14. The filament advancing assembly 16 includes a caterpillar advancing mechanism 68 having two parallel driven tracks which are symmetrically disposed to the common axis 26 for engaging therebetween the final product so as to cause the advancement of the elongated flexible elements 28*a* and 28*b* through the apparatus 10. However, it is understood that any other pulling mechanism adapted to uniformly pull on the elongated elements to displace the elements forward, at a same speed, through the apparatus may be provided. The caterpillar advancing mechanism 68 may be driven by an independent motor (not shown) or, alternatively, through a variable transmission (not shown) which in turn may be coupled to the motor 40 or to any other appropriate motor. Hence, it is the caterpillar advancing mechanism 68 which dictates the advancement speed of the elements 28*a* and 28*b*. Accordingly, by adjusting the rotational speed of the caterpillar advancing mechanism 68 relative to the rotational speed of the flyer 48, the elements 28*a* and 28*b* may be assembled in the gathering assembly 14 with a constant helical pitch. In other words, to produce a cable having a constant helical pitch, the speed ratio between the flyer 48 and the caterpillar advancing mechanism 68 must be constant during all of the assembly operation. Indeed, different speed ratios between the flyer 48 and the caterpillar advancing mechanism 68 will result in different helical pitches in the final product.

Instead of using expensive and sophisticated electronic equipment to vary the rotational speed of the filament advancing assembly 16 with respect to the rotational speed of the flyer 48 in order to manufacture assembled products having different helical pitches, it is contemplated to replace the caterpillar advancing mechanism 68 by a capstan having interchangeable capstan wheels of different diameters for each desired helical pitch, thereby allowing to change the advancement speed of the elements 28*a* and 28*b* without having to modify the rotational speed of the filament advancing assembly 16. Accordingly, to manufacture a cable of a given helical pitch, one predetermined diameter of capstan wheel would be used and to manufacture a cable of a different helical pitch another predetermined diameter of capstan wheel would be provided. Therefore, there would be a capstan wheel diameter associated with each desired helical pitch. By using the motor 40 for driving the capstan (not shown) via a conventional transmission mechanism and by providing interchangeable capstan wheels of different diameters, the speed ratio between the capstan and the flyer 48 is precisely controlled and cables of different helical pitches may be manufactured without having to modify the rotational speed ratio between the flyer 48 and the capstan, as the advancement speed of the elements 28*a* and 28*b* is a function of the rotational speed of the capstan wheels and the radii thereof. This manner of proceeding is more accurate, as it does not require to vary the rotational speed of the electrical motor driving the capstan to change the helical pitch of the assembled product.

In operation, the elements 28*a* and 28*b* are unwound from their respective supply spools 20*a* and 20*b* and are directly guided to the flyer 48 which rotates at a predetermined speed relative to the speed of the caterpillar advancing mechanism 68 which pulls the elements 28*a* and 28*b* outside of the supply spool and flyer assembly 12, thereby, simultaneously causing the supply spools 20*a* and 20*b* to rotate at a different speed than the rotational speed of the rotating shafts 22 and 24 and thus than that of the flyer 48. As the elements 28*a* and 28*b* are unwound from the supply spools 20*a* and 20*b*, they are directed to the closing die 60 where they are helically wound about the common axis 26 according to the rotary motion of the flyer 48.

Again, it is the speed ratio between the flyer 48 and the caterpillar advancing mechanism 68 which defines the helical pitch and thus it must be constant from the beginning to the end of the operations to obtain a final product, such as a cable, which has a substantially uniform helical pitch throughout the length thereof. This manner of controlling the helical pitch is simpler and more efficient than Krafft's method in aforementioned U.S. Pat. No. 4,709,542 which consists of controlling the rotational speed of the flyer relative to the rotational speed of the supply spools.

It will be appreciated that as the elements 28*a* and 28*b* are advanced through the supply spool and flyer assembly 12 by the caterpillar advancing mechanism 68, the winding diameters of the supply spools 20*a* and 20*b* are gradually reduced and thus their rotational speeds are increased such as to preserve a constant advancement speed. Accordingly, to apply a constant tension in each element 28*a* and 28*b*, the magnetising torques exerted by the hysteresis brakes 44 and 46 on the supply spools 20*a* an 20*b*, respectively, are adjusted so as to provide an appropriate opposition to the rotational movement of the supply spools 20*a* and 20*b*. Generally, as the torques applied on the supply spools 20*a* and 20*b* through the tension forces in the elements 28*a* and 28*b* are proportional to the winding diameters of the supply spools 20*a* and 20*b* and as these winding diameters become reduced during the operation of the apparatus 10, the magnetising torques exerted by the hysteresis brakes 44 and 46 must be adjusted, i.e. reduced, so as to preserve a constant tension in individual elements 28*a* and 28*b* throughout the assembly operations.

By having separate and independent supply spools 20*a* and 20*b* which are respectively provided with single elements 28*a* and 28*b* and by having distinct hysteresis brakes 44 and 46 acting on each of the supply spools 20*a* an 20*b*, it is possible to control the amount of tension in each element 28*a* and 28*b* to prevent one of the elements 28*a* and 28*b* from being wound with less tightness than the other in the final product, thereby contributing to enhance the overall quality of the final product.

Furthermore, the supply spools 20*a* and 20*b* may have different diameters, as they are separated and independently controlled.

At its exit of the caterpillar advancing mechanism 68, the final product may be directed to the take-up spool assembly 18 or, alternatively, to any other subsequent handling steps for the treatment or the modification of the assembled product. For instance, the assembled product may be directed to an extrusion unit. As illustrated in FIG. 1, the take-up spool assembly 18 includes a take-up spool 70 rotatably driven by a motor 72 through a rotating shaft 74 or a clutch. An electro-mechanical brake (not shown) with a motor may be mounted on the rotating shaft 74 to control the rotational movement of the take-up spool 70, thereby eliminating the utilisation of a dancer. Accordingly, the electro-mechanical brake (not shown) may be adjusted at different tensions depending on the speed of the caterpillar advancing mechanism 68 and the amount of final product loaded onto the take-up spool 70 so as to wind the final product at an appropriate tension on the take-up spool 70. Alternatively, a dancer (not shown) with a motor can be used to control the rotational movement of the take-up spool 70. As for the electro-mechanical brake (not shown), the dancer (not shown) can be adjusted to wind the final product at an appropriate tension on the take-up spool 70.

It is pointed out that the take-up spool assembly 18 is only used to receive the final product and thus it does not have any influence on the rate at which the final product is produced. Indeed, as described herein before, it is the caterpillar advancing mechanism 68 which dictates the advancement speed of the elements 28*a* and 28*b*. The take-up spool assembly 18 is not suited to control the advancement speed of the elements 28*a* and 28*b*, as the inertia of the take-up spool 70 changes as the elements 28*a* and 28*b* are wound thereon, thereby rendering the control of the advancement speed of the elements more complicated. Once the take-up spool 70 has been completely loaded with the final product, the production is stopped and the take-up spool 70 is replaced by an empty take-up spool which is not necessarily identical to the completely loaded take-up spool.

Speed sensors (not shown) are provided for measuring the rotational speeds of the flyer 48 and of the caterpillar advancing mechanism 68. The sensed data are sent to a control system (not shown) which is adapted to control and adjust the rotational speeds of the flyer 48 and of the caterpillar advancing mechanism 68 so that a constant speed ratio between the flyer 48 and the caterpillar advancing mechanism 68 is maintained at all times to thus obtain a final product having a constant helical pitch throughout the length thereof. Alternatively, when the filament advancing assembly 16 is provided in the form of a capstan (not shown), a constant helical pitch can be achieved by changing the diameter of the capstan itself, as explained hereinbefore.

Each pulley 66, illustrated in FIG. 2, may be mounted on a load cell (not shown) for measuring the tension in the elements 28*a* and 28*b*. The control system receives signals from the load cell, and it is operative for determining the voltage to send to each hysteresis brake controller so that the amount of tension in each element 28*a* and 28*b* remains constant and equal to one another as they are unwound from their respective supply spools 20*a* and 20*b*.

Alternatively, speed sensors (not shown) may be provided for sensing the rotational speed of each supply spool 20*a*, 20*b* and for measuring the rotational speed at the exit of the caterpillar advancing mechanism 68, thereby allowing to determine the diameter of elements 28*a* and 28*b* wound on the supply spools 20*a* and 20*b*, respectively. The voltage to send to each hysteresis brake controller can then be determined by the control system (not shown) to thus ensure that a constant tension is maintained in the elements 28*a* and 28*b* as they are unwound from their respective supply spools 20*a* and 20*b*.

The control system also permits to detect the rupture of the elements 28*a* and 28*b*. In the event that one of the elements 28*a* and 28*b* breaks, the rotational speed of the supply spool associated therewith becomes equal to the rotational speed of the flyer 48. Accordingly, the control system (not shown) has been instrumented so as to compare the data received from the speed sensors of the flyer 48 and of the supply spools 20*a* and 20*b* and to emit a warning signal when the rotational speed of one of the supply spools 20*a* and 20*b* is equal to that of the flyer 48. It is pointed out that this is possible because the supply spools 20*a* and 20*b* are each provided with a single element 28*a* and 28*b*, respectively. Indeed, if there were more than one element per supply spool, the rotational speed thereof would not be affected by the breaking of only one of the elements, thereby resulting in the production of a low-quality final product.

While the apparatus 10 is normally operated for helically assembling elements 28*a* and 28*b* about a common axis, it may also be operated for winding elements 28*a* and 28*b* around an advancing core filament or wire which is axially displaced through the apparatus 10 along the common axis 26 by the pulling action of the capstan 68. Hence, the advancing core filament and the elements 28*a* and 28*b* would have the same advancement speed. It is understood that when it is desired to obtain a final product having a core element and a single filament wound thereon, the apparatus may comprise only one supply spool instead of two as described hereinbefore.

It is noted that the motors 40 and 72 may be electronically controlled or, alternatively, a variable transmission may be used to provide a large flexibility of utilisation.

Figure 3:
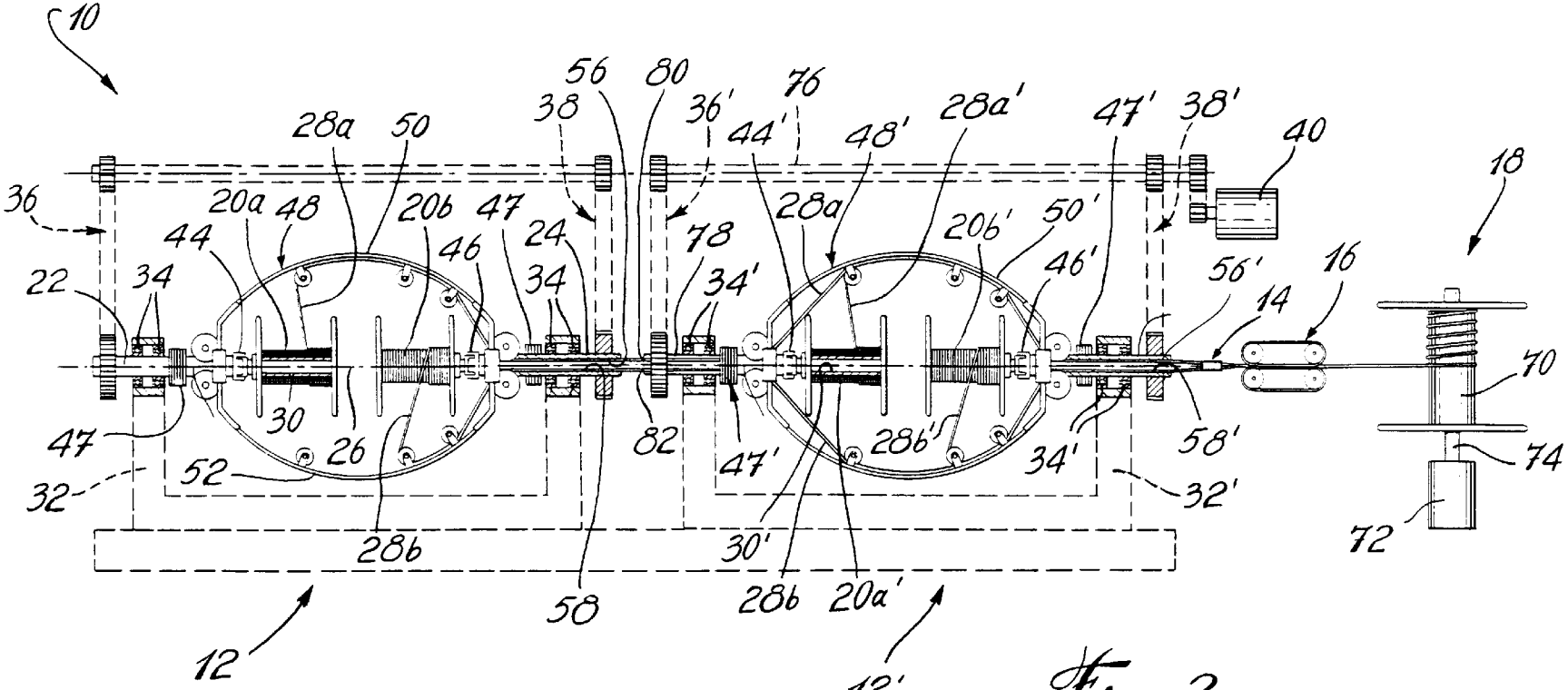
FIG. 3 is a schematic side elevational view of a wire assembly apparatus, wherein a plurality of supply spools and flyer assemblies are disposed in series in accordance with a second embodiment of the present invention.

FIG. 3 illustrates a second preferred embodiment of the present invention, wherein the apparatus 10' comprises two supply spool and flyer assemblies 12 and 12' mounted in series upstream of the gathering assembly 14, the filament advancing assembly 16 and the take-up spool assembly 18. The apparatus 10' is operational for helically assembling four elongated flexible elements 28*a*, 28*b*, 28*a'* and 28*b'* in the gathering assembly 14 about a common axis 26 or, alternatively, around a core filament (not shown) advancing axially through the apparatus 10' along the common axis 26. The supply spool and flyer assemblies 12 and 12' are driven by the same motor 40 through connecting shaft 76. However, it is understood that different motors may be used to respectively drive the supply spool and flyer assemblies 12 and 12'. The supply spool and flyer assembly 12' is provided with an upstream shaft 78 which defines two parallel axial passages 80 and 82 for respectively guiding the elements 28*a* and 28*b* emanating from the supply spool and flyer assembly 12 onto the flyer 48' of the supply spool and flyer assembly 12'. The remaining feature of the supply spool and flyer assembly 12' are similar to those of the supply spool and flyer assembly 12 and thus their duplicate description will be omitted.

In operation, the flyers 48 and 48' rotate at the same speed in a predetermined ratio to the rotational speed of the caterpillar advancing mechanism 68 which pulls on the elements 28*a*, 28*b*, 28*a'* and 28*b'* so as to impart to them a same advancement speed. The elements 28*a* and 28*b* are directly guided onto their respective arcuate members 50 and 52 and then they pass through the axial passages 56 and 58, respectively. Thereafter, the elements 28*a* and 28*b* are respectively received in the axial passages 82 and 80 defined in the upstream shaft 78 of the supply spool and flyer assembly 12'. Accordingly, the elements 28*a* and 28*b* enter in the supply spool and flyer assembly 12' without being helically assembled, as the same are conveyed in separate passages. The element 28*a* is then directly guided onto the arcuate member 50' with the element 28*a'*, while the element

28*b* is directly guided onto the arcuate member 52' with the element 28*b'*. The elements 28*a* and 28*a'* leave the supply spool and flyer assembly 12' through the axial passage 56', whereas the elements 28*b* and 28*b'* leave the supply spool and flyer assembly 12' through the axial passage 58'. The four elements 28*a,* 28*b,* 28*a'* and 28*b'* are then helically wound together about the common axis 26 as they pass through the gathering assembly 14. The final product is then received by the take-up spool assembly 18.

Again, when the apparatus 10' is used for obtaining a final product having a central core, a core filament is advanced through the apparatus 10', along the common axis 26, by the caterpillar advancing mechanism 68. As the core filament passes through the gathering assembly 14, the elements are hellically wound thereon to form a final product.

Although the supply spool and flyer assemblies 12 and 12' have been described as respectively including two supply spools 20*a,* 20*b,* 20*a'* and 20*b'*, it is noted that only one supply spool per supply spool and flyer assembly 12 and 12' may be provided depending on the number of elements required to form the final product.

Because the elements 28*a,* 28*a',* 28*b* and 28*b'* are assembled outside of the supply spool and flyer assemblies 12 and 12', it is possible to have a plurality of supply spool and flyer assemblies connected in series. Indeed, although the apparatus 10' has been described as having two supply spool and flyer assemblies 12 and 12', it is understood that a plurality of supply spool and flyer assemblies may be mounted in series upstream of the gathering assembly 14 or of a gathering point and of the filament advancing assembly 16 in order to obtain a final product which is formed of a plurality of individual elements.

According to further embodiments of the present invention, hydraulic brakes may be used to control the tension in each elongated element instead of the above described electromechanical brakes. Alternatively, motors or any other appropriate braking mechanism may also be used to control the amount of tension in the elements.

It is also noted that when only one supply spool is disposed within the flyer, the latter may include only one arcuate member.

Figure 4:
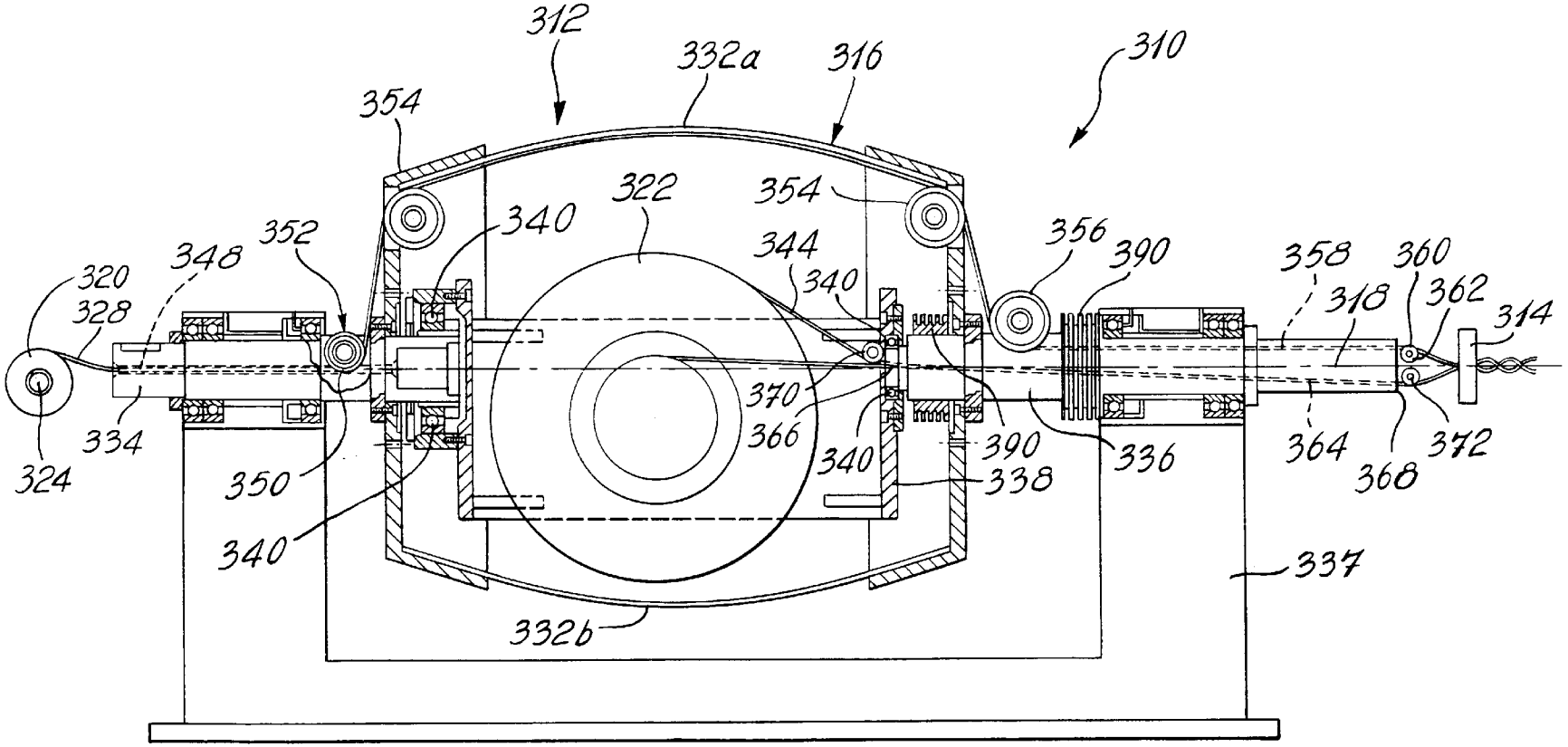
FIG. 4 is a schematic side elevational view of a supply spool and flyer assembly and of a gathering assembly in accordance with a third embodiment of the present invention.
Figure 5:
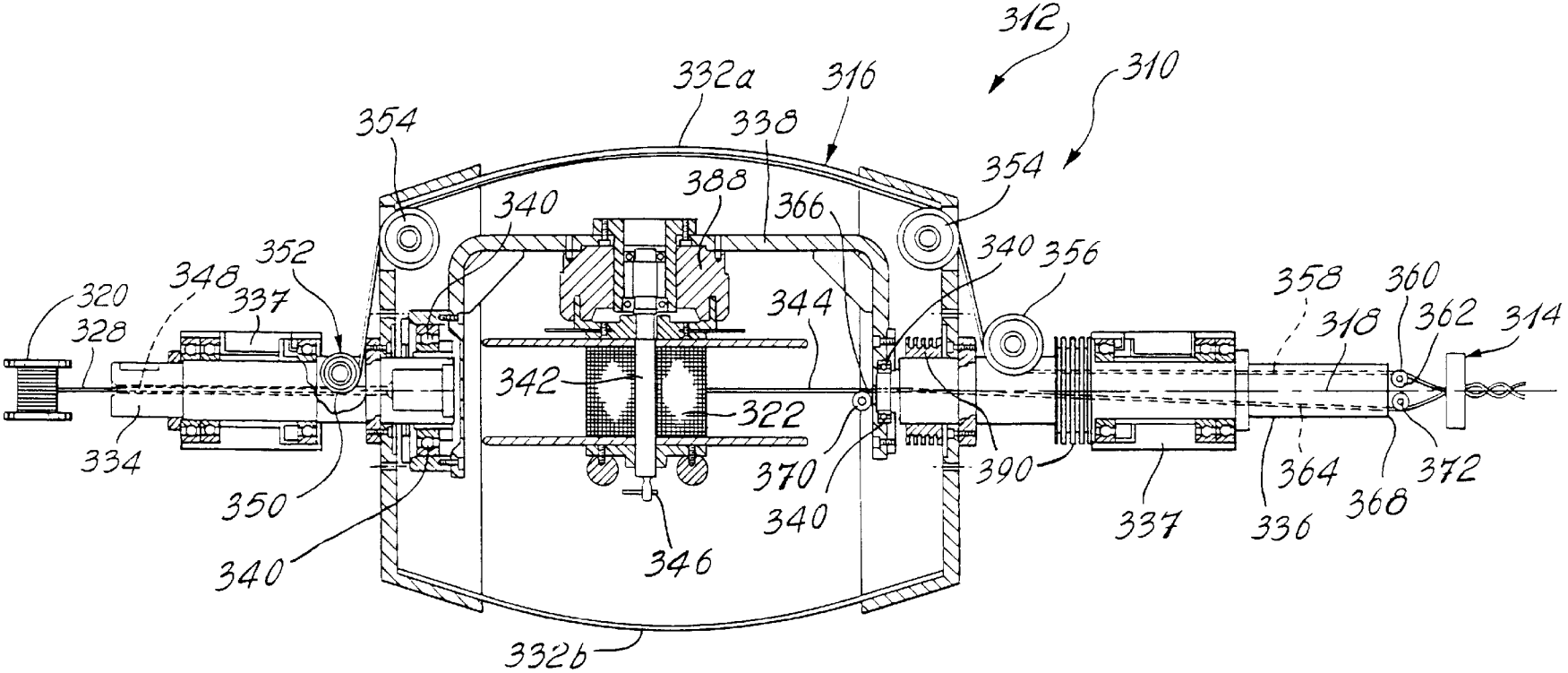
FIG. 5 is a schematic top plan view of the supply spool and flyer assembly and gathering assembly of FIG. 4.

FIGS. 4 and 5 illustrates a third embodiment of the present invention which is particularly suitable for helically assembling two elongated elements or filaments about a common axis to form a telecom cable, such as a local area network (LAN) cable.

As for the above described apparatus 10, the apparatus 310 comprises a supply spool and flyer assembly 312, an optional gathering assembly 314, a filament advancing assembly (not shown) and a take-up spool assembly (not shown). It is noted that the gathering assembly 314, the filament advancing assembly and the take-up spool assembly of the apparatus 310 are respectively similar to the corresponding gathering assembly 14, filament advancing assembly 16 and the take-up spool assembly 18 of the apparatus 10 and, therefore, their duplicate description will be omitted.

Referring now more specifically to FIGS. 4 and 5, it can be seen that the supply spool and flyer assembly 312 generally includes a flyer 316 mounted for rotation about a central axis 318, a first supply spool 320 disposed upstream of the flyer 316 and mounted for rotation about a first axis transversal to the central axis 318, and a second supply spool 322 disposed within an envelope described by a rotational movement of the flyer 316 and mounted for rotation about a second axis transversal to the central axis 318. By transversally mounting the first and second supply spools 320 and 322 with respect to the rotational axis of the flyer 316, i.e. the central axis 318, the production rate of the apparatus 310 may be increased. However, it is understood that the first and second supply spools 320 and 322 may be mounted for rotation about the central axis 318 or, alternatively, disposed at any suitable angle with respect thereto.

Figure 7:
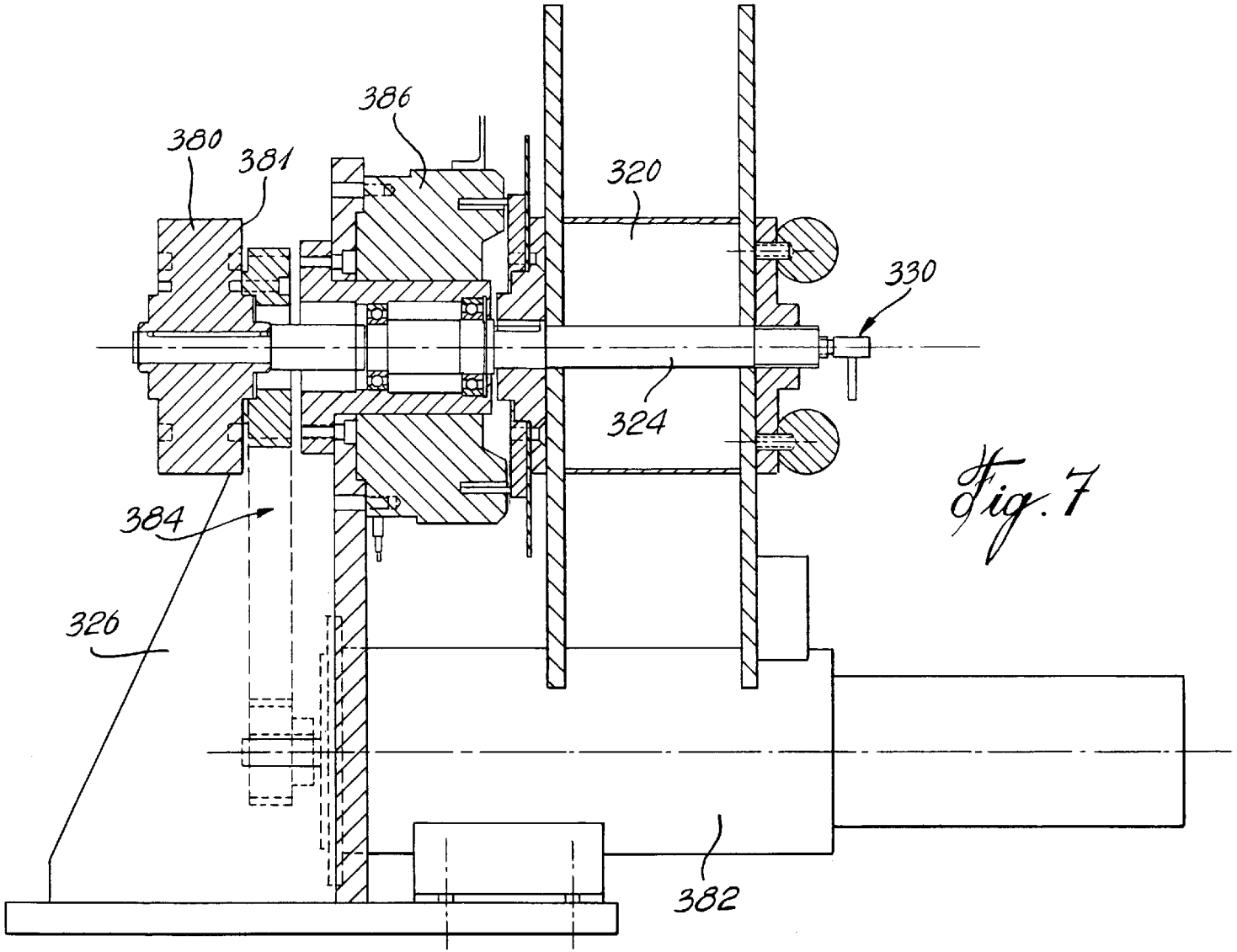
FIG. 7 is a schematic front plan view of a first supply spool of the supply spool and flyer assembly of FIG. 4.
Figure 8:
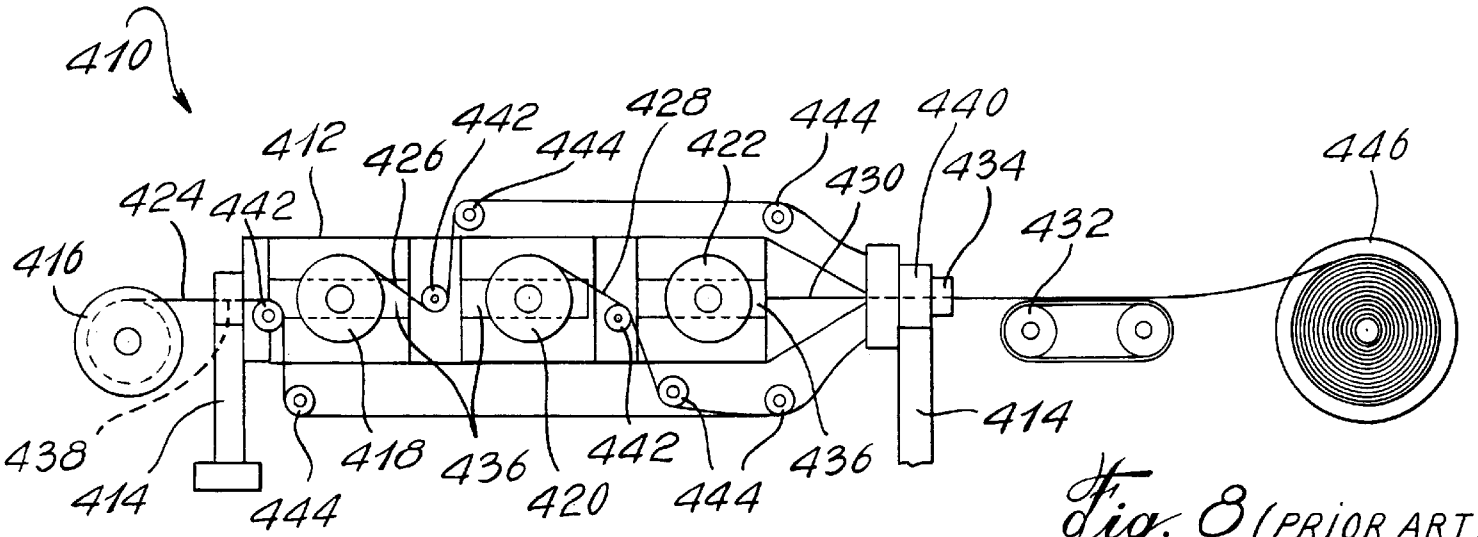
Fig. 8 (PRIOR ART)
FIG. 8 is a schematic longitudinal cross-sectional view of a conventional stranding apparatus suited to form steel cables.
Figure 9:
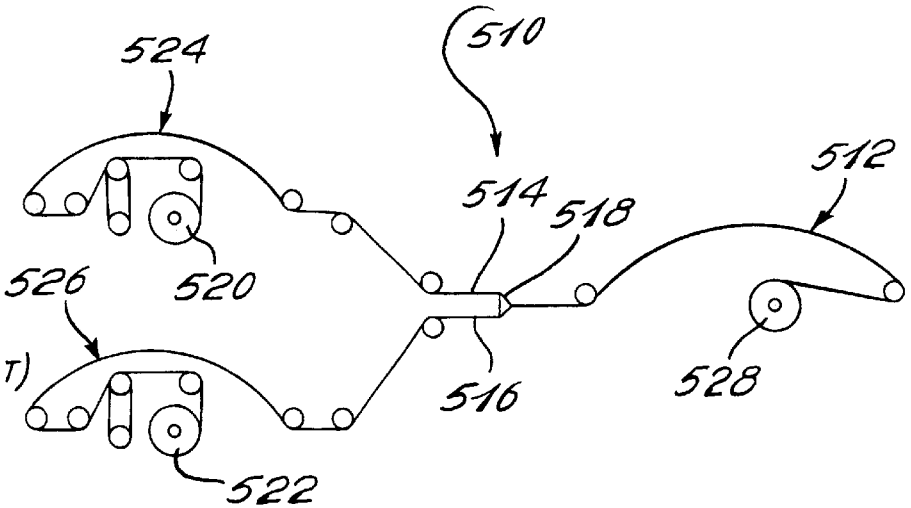
Fig. 9 (PRIOR ART)
FIG. 9 is a schematic side elevational view of a conventional stranding apparatus used to produce telecom cable.

As seen in FIG. 7, the first supply spool 320 is mounted for rotation with a shaft 324 journaled to an independent support structure 326 disposed upstream of the flyer 316. The first supply spool 320 has a single elongated flexible element 328 wound thereon. A locking mechanism 330 is provided to ensure that the first supply spool 320 remains in position on the shaft 324 during operation of the apparatus 310, while enabling the first supply spool 320 to be removed from the shaft 324 for replacement by another similar or different spool whenever required or desired.

As seen in FIGS. 4 and 5, the flyer 316 includes a pair of diametrically opposed arcuate members 332*a* and 332*b* which are fixedly mounted at opposed ends thereof to coaxial upstream and downstream shafts 334 and 336 journaled to a frame structure 337. The upstream and downstream shafts 334 and 336 are driven in unison by a suitable driving mechanism (not shown).

A cradle 338 is mounted at opposed ends thereof on bearings 340 provided at the inner ends of the upstream and downstream shafts 334 and 336, respectively. The bearings 340 ensure that the cradle 338 does not rotate with the upstream and downstream shafts 334 and 336. A rotatable shaft 342 is journaled to the cradle 338 for supporting the second supply spool 322. The second supply spool 322 has a single elongated flexible element 344 wound thereon. A locking mechanism 346 is provided to secure the second supply spool 322 in position on the shaft 342, while allowing the second supply spool 322 to be removed therefrom, if need be.

The upstream shaft 334 defines a central axial passage 348 for allowing the element 328 being unwound from the first supply spool 320 to get onto the flyer 316 at an entrance point 350 which is located on the central axis 318. An entrance pulley 352 mounted to the upstream shaft 334 and intersecting the central axial passage 348 directs the elongated element 328 to element guides, such as pulleys 354, depending from an inner side of the arcuate member 332*a*. The entrance point 350 of the flyer 316 may be defined as the point where the elongated element 328 receives a first twist, i.e. the point where the element 328 is in contact with the entrance pulley 352 on the central axis 318.

As the flyer 316 rotates and as the first supply spool 320 is fixed in a plane perpendicular to the rotating axis of the flyer 316, i.e. the central axis 318, the portion of the element 328 which is comprised between the entrance point 350 and the first supply spool 320 at a given moment is twisted onto itself. Accordingly, this same portion of the first element 328 will travel on the arcuate member 332*a* in a twisted state.

A pulley 356 is mounted on the downstream shaft 336 for directing the element 328 leaving the arcuate member 332*a* into an off-center axial passage 358 defined in the downstream shaft 336. It is understood that the pulley 356 rotates conjointly with the downstream shaft 336 and, thus, with the arcuate members 332*a* and 332*b*. The element 328 leaves the flyer 316 at an exit point 360 which generally corresponds to the point of contact between the elongated element 328 and a pulley 362 mounted at the outlet end of the downstream shaft 336 for rotation therewith. The pulley 362 guides the elongated element 328 emanating from the axial passage 358 to the gathering assembly 314, wherein the elongated element 328 will be helically assembled with the elongated element 344 about the central axis 318.

Since the filament advancing assembly (not shown) or the take-up spool assembly (not shown) of the apparatus 310 may be viewed as a fixed point, the portion of the elongated element 328 comprised between the exit point 360 and such a fixed point is twisted in a direction opposed to that previously imparted to the elongated element 328, thereby ensuring that the elongated element 328 be neutral in the assembled product, i.e. not twisted onto itself.

As opposed to the elongated element 328, the elongated element 344 is not directed onto one of the arcuate members 332*a* and 332*b*. Indeed, it is a guide system associated to the downstream shaft 336 which causes the elongated element 344 to rotate about the central axis 318.

The downstream shaft 336 defines a longitudinal passage 364 having an inlet end 366 centrally disposed with respect to the central axis 318 and an outlet end 368 which is off-center. An entrance pulley 370 is mounted to the cradle 338 adjacent the inlet end 366 of the downstream shaft 336 for centrally directing the elongated element 344 through the longitudinal passage 364 as the same is drawn from the second supply spool 322. An exit pulley 372 is mounted to the downstream shaft 336 adjacent the outlet end 368 for engaging the elongated element 344 as the same comes out of the longitudinal passage 364. By so deviating the elongated element 344 relative to the central axis 318 and by driving the downstream shaft 336 in rotation, the element 344 is caused to rotate about the central axis 318. As the exit pulley 372 rotates with the downstream shaft 336 and as the entrance pulley 370 does not rotate in a plane normal to the rotating axis of the downstream shaft 336, namely the central axis 318, the portion of the element 344 comprised between the entrance pulley 370 and the exit pulley 372, at a given moment, is twisted onto itself Accordingly, the elongated element 344 is in a twisted state as it travels through the longitudinal passage 364.

In the same way, the gathering assembly 314, the element advancing assembly (not shown) or the take-up spool assembly (not shown) may be viewed as a fixed point relative to the exit pulley 372. Accordingly, the portion of the elongated element 344 comprised between the exit pulley 372 and such a fixed point is twisted in a direction opposite to that previously imparted thereto, thereby ensuring the neutrality of the element 344, i.e. its untwisted condition.

Thus, by passing the elongated element 344 through the longitudinal passage 364 defined in the downstream shaft 336 which rotates about the central axis 318, the element 344 is caused to rotate about the central axis 318 to be ultimately helically assembled with the element 328 about the central axis 318 in the gathering assembly 314.

The assembled product is then drawn out of the gathering assembly 314 by the filament advancing assembly (not shown) and wound onto the take-up spool of the take-up spool assembly (not shown).

Figure 6:
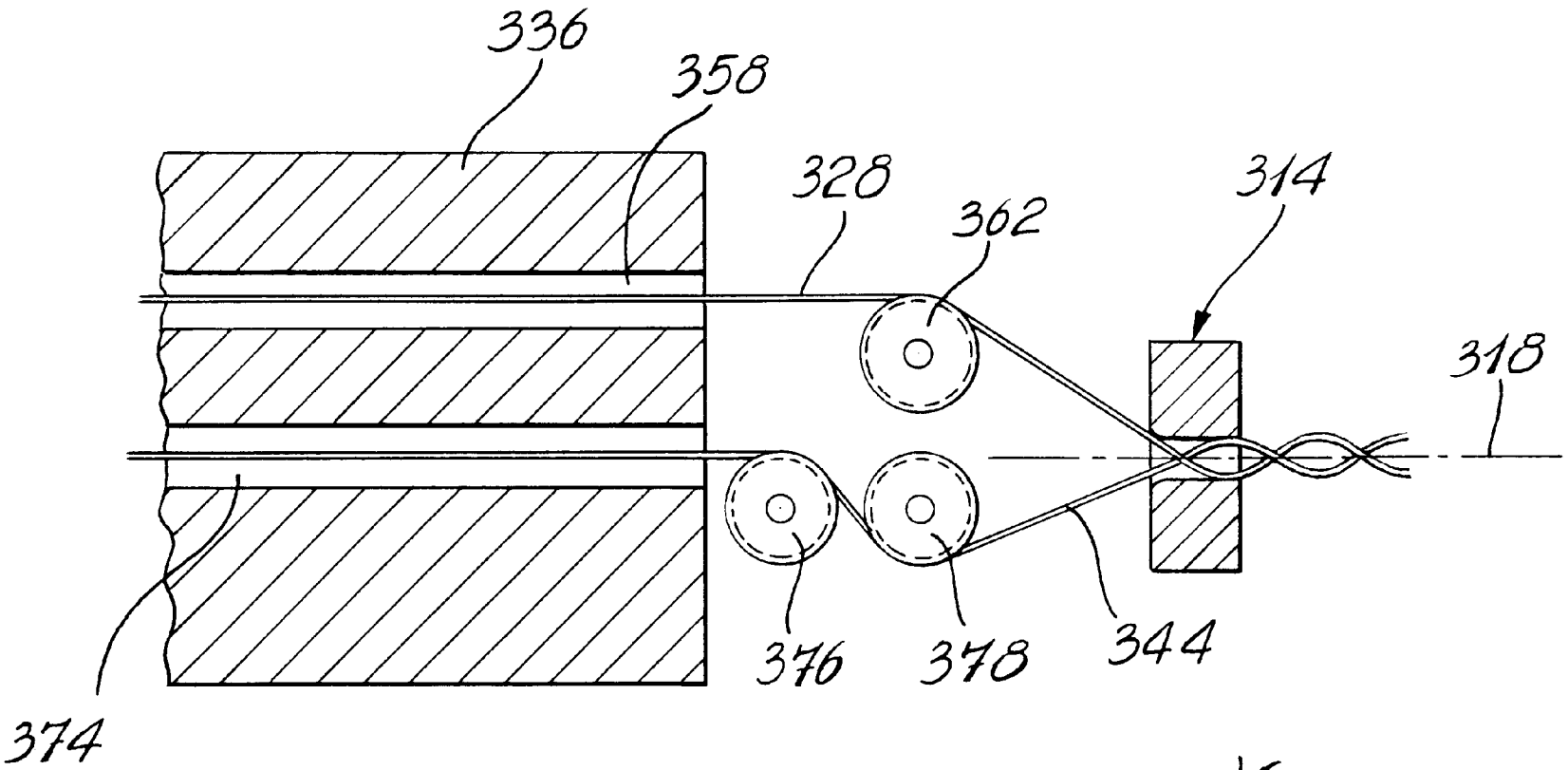
FIG. 6 is a schematic enlarged cross-sectional view of a downstream end portion of the supply spool and flyer assembly showing a further possible filament path arrangement thereof.

Instead of the above described longitudinal passage 364, a passage 374 coaxial to the central axis 318 may be defined in the downstream shaft 336 and used in combination with a pair of pulleys 376 and 378 as seen in FIG. 6 to cause the element 344 to rotate about the central axis.

In this case, the element 344 engages the entrance pulley 370 disposed adjacent to the inner end of the downstream shaft 336 and then travels centrally through the axial passage 374 in a twisted state as described hereinbefore. The twisted element 344 emanating from the axial passage 374 engages the first pulley 376 which rotates with the downstream shaft 336. The twisted element 344 is then deviated off-axis by the second pulley 378 which also rotates with the downstream shaft 336, thereby causing the element 344 to rotate about the central axis 318. The portion of the element 344 downstream of the pulley 378 is untwisted as per the way described hereinbefore.

The tension in the element 328 is controlled in a way similar to that described with respect to the first embodiment, i.e. by applying an opposition to the pulling action of the filament advancing unit (not shown). However, when larger supply spools are used, the inertia of the supply spools is more important and consequently it becomes necessary to drive the supply spools in rotation to prevent the elements from rupturing due to an excessive pulling action of the filament advancing unit. In the past, this was accomplished by means of a DC or AC motor coupled to a control box adapted to accelerate and decelerate the motor so as to maintain the amount of tension constant in the elements throughout the stranding process. Applicant herewith discloses an alternative to such a system which permits to continuously power the drive motor at a constant speed during all the stranding process thereby eliminating the necessity of having a control box coupled to the motor.

As seen in FIG. 7, an electro-mechanical clutch, such as a hysteresis clutch 380, is mounted at one end of the shaft 324 opposed to the supply spool 320 and is driven by a motor, for instance an electrical motor 382, via a conventional belt and pulley transmission 384. The hysteresis clutch 380 includes a casing 381 within which outer and inner portions (not shown) of the clutch are disposed. The casing 381 is connected to the electrical motor 382 by means of the transmission 384. The outer portion of the hysteresis clutch 380 is secured to the casing 381, whereas the inner portion is keyed to the shaft 324. The inner and outer portions may be coupled to each other via a magnetising torque. An electro-mechanical brake, such as a ZF brake 386, is mounted to the support structure 326 between the hysteresis clutch 380 and the first supply spool 320 to apply a braking torque on the first supply spool 320. As it is well known in the art, a conventional dancer (not shown) is provided for adjusting the voltage of the ZF brake 386 in accordance with the amount of tension exerted on the element 328 as the same is being drawn off the supply spool 320.

In operation, the drive shaft of the electric motor 382 rotates at a constant speed to drive the hysteresis clutch 380. However, as the initial braking torque of the ZF brake 386 is greater than the magnetising torque developed by the hysteresis clutch 380, the latter slips and thus no driving torque is transmitted to the shaft 324 and the first supply spool 320. Then, as the element 328 starts to be drawn off the supply spool 320, the dancer (not shown) is displaced such as to reduce the voltage of the ZF brake 386 in order to reduce the braking torque thereof down to a value which is inferior to the magnetising torque of the hysteresis clutch 380, thereby enabling the hysteresis clutch 380 to drive the shaft 324 and the first supply spool 320. When the rotational speed of the first supply spool 320 reaches a certain value implying that the tension on the element 328 is to decrease, the dancer (not shown) is displaced in a direction opposite to its previous displacement thereby increasing the voltage of the ZF brake 386 so as to reduce the rotational speed of the first supply spool 320 and consequently cause the hysteresis clutch 380 to slip. Similarly, when the amount of tension exerted on the element 328 is to increase, the dancer is displaced so as to reduce the voltage of the ZF brake 386 to thus enable the hysteresis clutch 380 to drive the first supply spool 320. Accordingly, the amount of tension on the element 328 can be maintained constant throughout the stranding process.

A similar system may be provided for controlling the tension on the element 344 wound onto the second supply spool 322. However, in the embodiment illustrated in FIG. 5, the second supply spool 322 is not driven and the tension on the element 344 is control by means of a ZF brake 388 mounted to the cradle 338 for offering an adjustable opposition to the pulling action of the filament advancing assembly (not shown).

Finally, as seen in FIGS. 4 and 5, conductive elements, such as brush 390, are provided for conducting current to the ZF brake 388 and/or to any other electrical component installed within the envelope defined by the rotational movement of the flyer 316.

Figure 10:
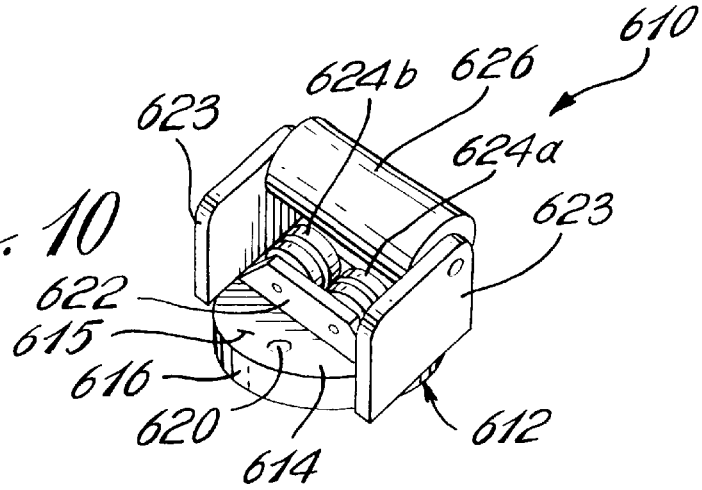
FIG. 10 is a perspective view of a tension equaliser adapted to be disposed at an exit end of a supply spool and flyer assembly in accordance with a fourth embodiment of the present invention.
Figure 11:
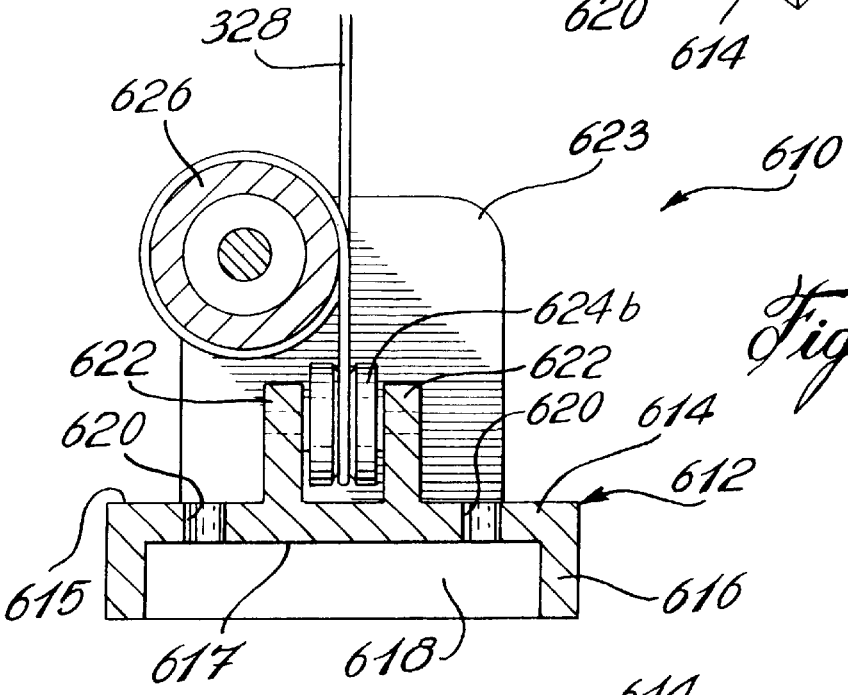
FIG. 11 is a cross-sectional view of the tension equaliser of FIG. 10.
Figure 12:
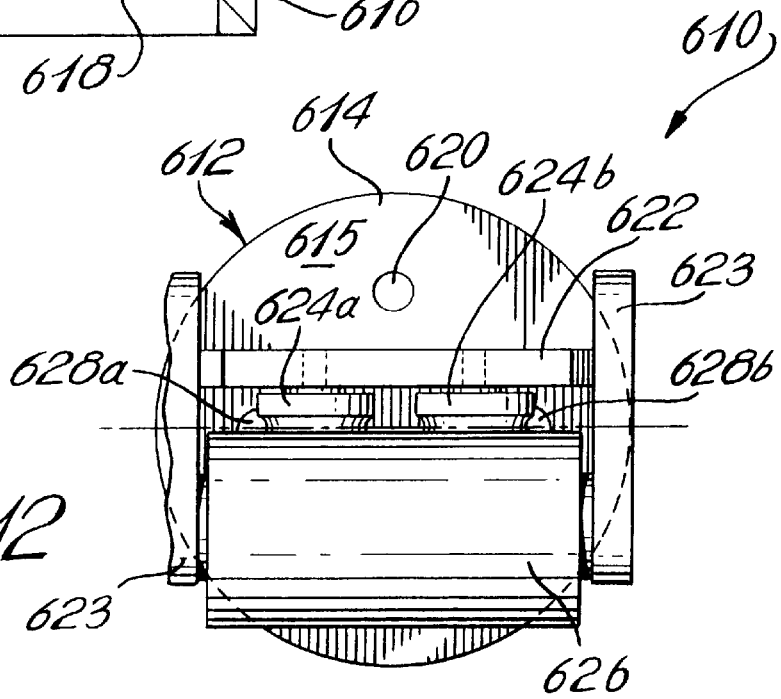
FIG. 12 is a top plan view of the tension equaliser of FIG. 10.

FIGS. 10 to 12 illustrate a tension equaliser 610 which may be mounted at the exit end of the downstream shaft 24,336 for ensuring that the elongated elements 28*a,* 28*b,* 328, 344 be assembled at the same tension.

The tension equaliser 610 comprises a support structure 612 including a circular base plate 614 having a top surface 615 and a bottom surface 617 from the periphery of which a cylindrical wall 616 extends so as to define a cavity 618 configured to receive the exit end of the downstream shaft 24,336. Holes 620 are defined in the base plate 614 for receiving fasteners (not shown) to secure the tension equaliser 610 to the downstream shaft 24,336.

The support structure 612 further includes a pair of parallel central walls 622 extending at right angle from the top surface 615 of the base plate 614. A pair of guide pulleys 624*a* and 624*b* are mounted between the central walls 622 on respective axles (not shown) extending transversally therethrough. A pair of parallel side plates 623 extend at right angles from the top surface 615 of the base plate 614 on opposed ends of the central walls 622 for supporting an axle (not shown) on which is mounted a roller 626.

As seen in FIG. 12, first and second passages 628*a* and 628*b* are defined in the base plate 614 for respectively allowing the elongated elements 28*a,* 28*b* 328, 344 to access respective guide pulleys 624*a* and 624*b* before being directed onto the roller 626.

In operation, the elongated elements 28*a,* 28*b,* 328 and 344 pass from respective guide pulleys 624*a* and 624*b* onto the roller 626 around which the elements 28*a,* 28*b,* 328, 344 are wound a complete turn (360 degrees) at spaced-apart axial locations on the roller 626 before being directed to the gathering point (not shown) located downstream of the tension equaliser 610. This is shown in respect of elongated element 328 in FIG. 11. By passing the elongated elements 28*a,* 28*b,* 328 , 344 about a common roller, the tension in the elongated elements 28*a,* 28*b,* 328, 344 is equalised, thereby contributing to enhance the overall quality of the assembled product.

What is claimed is:

1. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, wherein said first guide means and said first supply spooling means are configured to cause said first filament to pass by said central axis and then onto said flyer means where said first filament is deviated off-axis before being returned to said central axis at the gathering point, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said second guide means and said second supply spooling means are configured to cause said second filament to pass by said central axis and then to said second guide means where said second filament is deviated off-axis before being returned to said central axis at the gathering point.

2. A supply spool and flyer assembly as defined in claim 1, wherein said first and second filaments are respectively twisted with respect to first and second fixed points located on said central axis, said first and second filaments being offset from said central axis when said first and second filaments respectively move out of engagement from said first and second guide means.

3. A supply spool and flyer assembly as defined in claim 1, wherein said second guide means include a passage defined in a downstream portion of said axle means for said second filament to pass through to access the gathering point, said passage having an entry substantially centrally disposed relative to said central axis and an exit offset from said central axis.

4. A supply spool and flyer assembly as defined in claim 3, wherein a first guide member is provided adjacent said entry for guiding said second filament substantially centrally of said passage, and wherein said second guide means further comprise a second guide member disposed adjacent said exit of said passage, said second guide member being connected to said axle means for rotation therewith.

5. A supply spool and flyer assembly as defined in claim 4, wherein said first and second guide members respectively include first and second pulleys.

6. A supply spool and flyer assembly as defined in claim 1, wherein said second guide means include a passage defined in a downstream portion of said axle means for said second filament to pass through to access the gathering point, said passage and said central axis being substantially coaxial.

7. A supply spool and flyer assembly as defined in claim 6, wherein said second guide means further include first and second guide members mounted for rotation with said axle means about said central axis, said first guide member being disposed at a downstream end of said axial means for engaging said second filament on said central axis, and said second guide member being disposed downstream of said first guide member for deviating said second filament off-axis before said second filament enters the gathering point.

8. A supply spool and flyer assembly as defined in claim 7, wherein a third guide member is disposed upstream of an entry of said passage for directing said second filament substantially centrally of said passage, said third guide member being fixed relative to said axle means.

9. A supply spool and flyer assembly as defined in claim 1, wherein said axle means include upstream and downstream shafts respectively supporting first and second opposed ends of said flyer means, said upstream shaft defining a first passage which is substantially coaxial to said central axis for said first filament to pass through to get onto said flyer means at a point which is substantially located on said central axis, and wherein said second guide means include a second passage which is defined in said downstream shaft for said second filament to pass through to access the gathering point.

10. A supply spool and flyer assembly as defined in claim 9, wherein said second passage becomes off-axis as said second passage extends in a downstream direction.

11. A supply spool and flyer assembly as defined in claim 9, wherein said second passage is substantially coaxial to said central axis, and wherein said second guide means further include at least one guide member mounted to said downstream shaft adjacent an exit of said second passage for deviating said second filament off-axis before said second filament reaches the gathering point.

12. A supply spool and flyer assembly as defined in claim 11, wherein said downstream shaft further defines an off-center axial passage for said first filament to pass through to access the gathering point.

13. A supply spool and flyer assembly as defined in claim 1, wherein said first and second supply spooling means are mounted for rotation about respective axes, said axes being transversal to said central axis.

14. A supply spool and flyer assembly for an apparatus adapted to helically assemble a pair of elongated flexible elements about a central axis as said elongated flexible elements are passed through a gathering point, said supply spool and flyer assembly comprising first supply spooling means having a first elongated flexible element wound thereon, flyer means disposed downstream of said first supply spooling means relative to a filament supply direction of said first elongated flexible element and upstream of the gathering point, said flyer means being mounted on axle means for rotation therewith about said central axis and defining a first guide path for said first elongated flexible element, whereby rotation of said flyer means will cause said first elongated flexible element to rotate about said central axis as said first elongated flexible element is moved through said first guide path, and second supply spooling means disposed within an envelope defined by a rotational movement of said flyer means about said central axis, said second supply spooling means having a second elongated flexible element wound thereon, said second elongated flexible element being moved through a second guide path extending through said axle means and to the gathering point so as to deviate off-axis said second elongated flexible element at a location comprised between said envelope and the gathering point, whereby rotation of said axle means will cause said second elongated flexible element to rotate about said central axis such that when said first and second elongated flexible elements return to the central axis at the gathering point, said first and second elongated flexible elements will be helically assembled together.

15. A supply spool and flyer assembly as defined in claim 14, wherein said first and second elongated flexible elements are respectively twisted, as a result of a rotational movement of said flyer means and said axle means, with respect to first an second fixed points located on said central axis.

16. A supply spool and flyer assembly as defined in claim 14, wherein said axle means define a substantially linear passage downstream of said second supply spooling means for said second elongated flexible element to pass through to access the gathering point, said passage having an entry substantially centrally disposed with respect to said central axis and an exit offset from said central axis.

17. A supply spool and flyer assembly as defined in claim 16, wherein first and second guide means are respectively provided adjacent said entry and said exit of said passage for directing said second elongated flexible element centrally of said passage, at least one of said first and second guide means rotating conjointly with said axle means.

18. A supply spool and flyer assembly as defined in claim 17, wherein said first and second guide means include pulleys.

19. A supply spool and flyer assembly as defined in claim 14, wherein said axle means define a passage downstream of said second supply spooling means relative to a filament supply direction of said second elongated flexible element for said second elongated flexible element to pass through to access the gathering point, said passage and said central axis being substantially coaxial, and wherein guide means are connected to said axle means downstream of an exit of said passage for deviating off-axis said second elongated flexible element before said second elongated flexible element reaches the gathering point.

20. A supply spool and flyer assembly as defined in claim 19, wherein said guide means include at least first and second guide means, said first guide means being disposed for engaging said second elongated flexible element on said central axis, whereas said second guide means being disposed next to said first guide means for engaging said second elongated flexible element at a location spaced from said axis.

21. A supply spool and flyer assembly as defined in claim 14, wherein said axle means include upstream and downstream shafts respectively supporting first and second opposed ends of said flyer means, said upstream shaft defining a first passage substantially coaxial to said central axis for said first elongated flexible element to pass through to get onto said flyer means at a point which is substantially located on said central axis, said downstream shaft defining a second passage for said second elongated flexible element to pass through to access the gathering point.

22. A supply spool and flyer assembly as defined in claim 21, wherein said second passage becomes off-axis as said second passage extends in a downstream direction relative to a filament supply direction of said second elongated flexible element.

23. A supply spool and flyer assembly as defined in claim 21, wherein said second passage is substantially coaxial to said central axis, and wherein guide means rotating conjointly with said upstream and downstream shafts are provided adjacent an exit of said second passage for deviating said second elongated flexible element off-axis before said second elongated flexible element reaches the gathering point.

24. A supply spool and flyer assembly as defined in claim 21, wherein said downstream shaft further defines an off-center axial passage for said first elongated flexible element to pass through to access the gathering point.

25. A supply spool and flyer assembly as defined in claim 21, wherein said upstream and downstream shafts are provided with guide means for respectively engaging said first and second elongated flexible elements so as to impart a twist thereto with respect to fixed points disposed at spaced-apart location on said central axis.

26. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said first and second filaments are respectively twisted with respect to first and second fixed points located on said central axis, said first and second filaments being offset from said central axis when said first and second filaments respectively move out of engagement from said first and second guide means.

27. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said second guide means include a passage defined in a downstream portion of said axle means for said second filament to pass through to access the gathering point, said passage having an entry substantially centrally disposed relative to said central axis and an exit offset from said central axis.

28. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said second guide means include a passage defined in a downstream portion of said axle means for said second filament to pass through to access the gathering point, said passage and said central axis being substantially coaxial.

29. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said axle means include upstream and downstream shafts respectively supporting first and second opposed ends of said flyer means, said upstream shaft defining a first passage which is substantially coaxial to said central axis for said first filament to pass through to get onto said flyer means at a point which is substantially located on said central axis, and wherein said second guide means include a second passage which is defined in said downstream shaft for said second filament to pass through to access the gathering point.

30. A supply spool and flyer assembly for an apparatus adapted to helically assemble a pair of filaments about a central axis as said filaments are passed through a gathering point, said supply spool and flyer assembly comprising first supply spooling means having a first filament wound thereon, flyer means disposed between said first supply spooling means and the gathering point, said flyer means being mounted on axle means for rotation therewith about said central axis, said flyer means being provided with first guide means for guiding said first filament along said flyer means, and second supply spooling means disposed within an envelope defined by a rotational movement of said flyer means about said central axis, said second supply spooling means having a second filament wound thereon, said axle means being provided, downstream of said second supply spooling means relative to a filament supply direction of said second filament, with second guide means configured to cause said second filament to rotate with said axle means about said central axis as said second filament is moved through said second guide means, wherein said first and second supply spooling means are mounted for rotation about respective axes, said axes being transversal to said central axis.

* * * * *